United States Patent [19]

Fantuzzo

[11] 4,006,981

[45] Feb. 8, 1977

[54] HALF TONE DEVELOPMENT FOR TOUCHDOWN SYSTEM

[75] Inventor: Joseph Fantuzzo, Webster, N.Y.

[73] Assignee: Xerox Corporation, Stamford, Conn.

[22] Filed: Oct. 2, 1975

[21] Appl. No.: 619,101

Related U.S. Application Data

[60] Continuation of Ser. No. 481,079, June 20, 1974, abandoned, which is a division of Ser. No. 351,221, April 16, 1973, Pat. No. 3,881,927.

[52] U.S. Cl. ..... 355/3 DD; 118/650; 118/651

[51] Int. Cl.[2] ..... G03G 15/08

[58] Field of Search ..... 355/3 DD; 96/1 SD; 427/14, 25; 118/637

[56] References Cited

UNITED STATES PATENTS

| | | | |
|---|---|---|---|
| 3,696,785 | 10/1972 | Andrus | 355/3 DD |
| 3,881,927 | 5/1975 | Fantuzzo | 96/1 SD |

*Primary Examiner*—L. T. Hix
*Assistant Examiner*—Kenneth C. Hutchison

[57] ABSTRACT

A touchdown system for obtaining many distinctive steps in grey scale rendition when developing solid areas comprises a toner laden donor member and a toner layer pattern forming member. The pattern forming member has an electrode arranged in such a manner thereon that when a predetermined field is established between the electrode and the donor member, a predetermined pattern of peaks and valleys will be formed in the toner layer. When this patterned toner layer is presented to an electrostatic solid area latent image, the weakest charged portions of the latent image will attract only the toner from the portion of the layer which is closest thereto i.e., the peaks, thereby presenting a dot pattern development thereon. The strongest charged portion of the electrostatic latent image will attract toner not only from the closest portion or peaks but will also attract toner from the valleys which will fully develop the image where the charge is strongest. The charged pattern of the latent image which is between the weakest and strongest charge will attract a broadening pattern of toner from the peaks as well as from the valleys as the charge gets stronger.

12 Claims, 4 Drawing Figures

HALF TONE DEVELOPMENT FOR TOUCHDOWN SYSTEM

This is a continuation, of application Ser. No. 481,079, filed June 20, 1974, now abandoned, which is a divisional of Ser. No. 351,221 filed Apr. 16, 1973, now U.S. Pat. No. 3,881,927.

This invention is concerned with an improvement to a "touchdown development" system. The term "touchdown development" as used in this application refers to the following system:

A toner laden rotating donor member (which may be a roller or an endless belt) is located adjacent to a moving photoreceptive surface bearing a latent electrostatic image thereon. The donor member is spaced from the photoreceptor so that a gap of about 2 to 10 microns exists between the toner layer surface and the photoreceptive surface. The toner on the donor member carries a charge in polarity opposite to the polarity of the electrostatic latent image. As the donor member carries toner past the latent image, the toner is attracted from the donor to the image to develop the image.

In developing solid areas with this touchdown system, there have been problems with achieving more than about three distinctive steps of grey scale rendition.

Accordingly, it is an object of this invention to provide a touchdown development system which provides for half-tone development of solid areas resulting in many distinctive steps of grey scale rendition.

Other objects of this invention will become apparent from the following description with reference to the drawings wherein.

Figure 1:
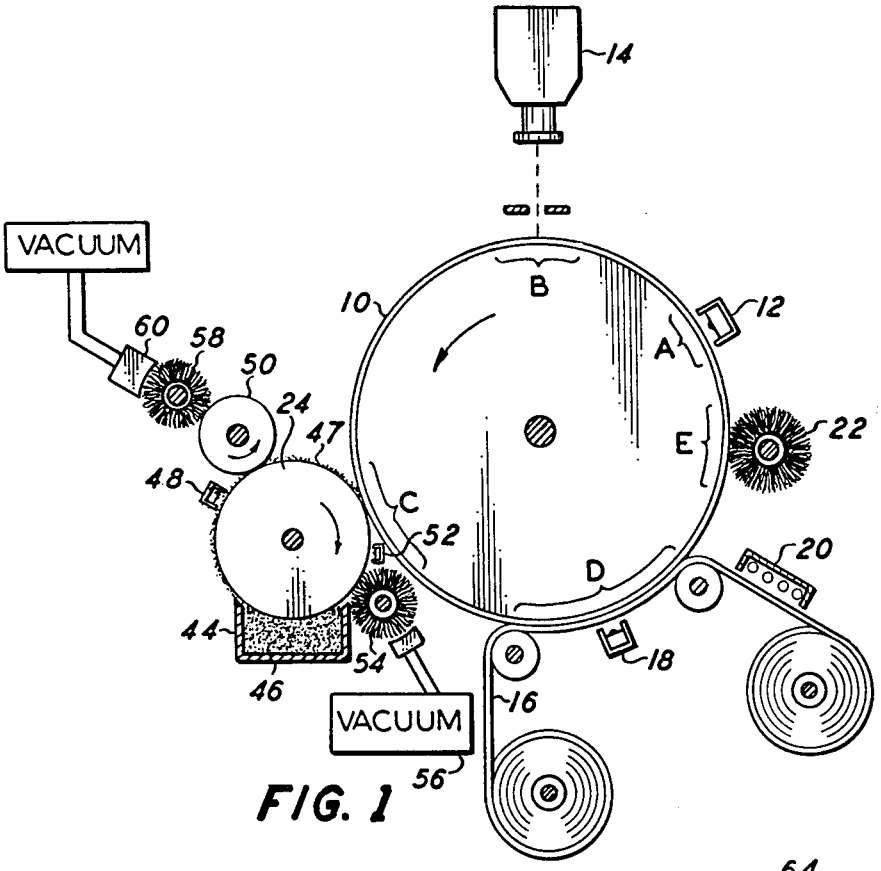
FIG. 1 is a schematic view of a touchdown development system.

Referring to FIG. 1, there is shown a xerographic reproduction system utilizing the concept of the present invention. In this apparatus a xerograhic plate is in the form of a drum 10 which passes through stations A through E in the direction shown by the arrow. The drum has a suitable photosensitive surface on which a latent electrostatic image can be formed. The plurality of stations about the periphery of the drum which carry out the reproduction process are: charging station A, exposing station B, developing station C, transfer station D, and cleaning station E. Stations A, B, D, and E represent conventional means for carrying out their respective functions and do not form a part of the present invention.

At station A, a corona charging means 12 places a uniform electrostatic charge on the photoconductive material. As the drum 10 rotates, a light pattern, by a suitable exposing apparatus 14, is exposed onto the charged surface of drum 10. The latent image thereby formed on the surface of the drum is developed by the application of toner particles at developing station C, which is described in greater detail below. After the image is developed at station C, it passes through transfer station D, wherein the toner is transferred to a sheet 16. A corona charging device 18 is utilized in the normal way to facilitate transfer and fuser device 20 is provided to fuse the toner to sheet 16. Following transfer of the developed image to the copy sheet, the drum rotates through cleaning station E, comprising cleaning brush 22 which cleans residual toner particles from the drum 10.

Figure 2:
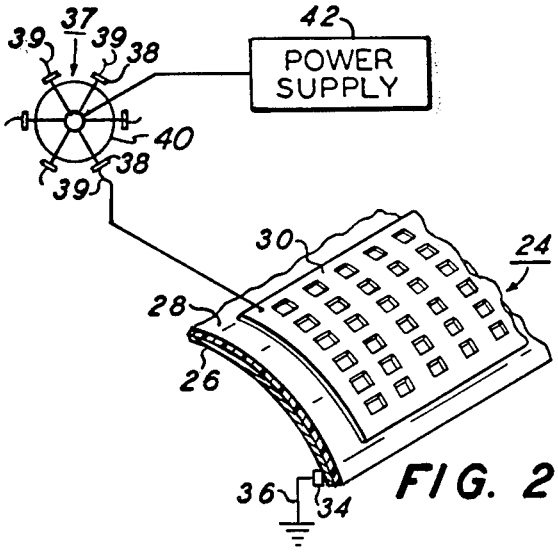
FIG. 2 is a partial schematic view of a microfield donor and a commutating system therefor.

Referring to FIG. 2, the apparatus includes a donor member 24 at the developing station C which comprises an aluminum drum 26 and a dielectric layer 28 separating the drum 26 from a copper grid pattern 30. There are a plurality of electrically isolated grid patterns 30 to allow a varying potential to be applied thereto in accordance with a position of a particular portion of the donor member 24 with respect to the various stations located around it. This is accomplished by connecting the aluminum drum to ground by contacting a brush 34 with the inner surface thereof and with an electrical lead 36. Individual electrical connections are made from each grid pattern 30 to a programmed means which will permit each grid pattern to be placed at ground potential or to some desired charge potential. This programmed means comprises a segmented slip ring 37 and electrical contacts 38 which are shown schematically in FIG. 2. In actual practice, a respective electrical lead 39 could be located inside of the donor member in electrical communication with a respective grid pattern while the other end of the respective electrical lead 39 is connected to a respective contact 38 which is in ring 37. A voltage source 42 can supply the appropriate potential to each segment 40 of the slip ring.

The donor member 24 is rotatably mounted adjacent a toner reservoir 44 containing a supply of toner particles 46 in order that a portion of its periphery comes into contact with toner 46. This portion of the donor member 24 is properly biased to attract a layer 47 of toner particles thereto. The donor roll is also located so as to provide a small gap of approximately 2–10 microns between the surface of drum 10 and the outer surface of a toner layer carried by donor roll 24. After a particular portion of the donor roll is rotated through the toner reservoir, that portion of the donor rotates past a corona charging device 48 which charges the toner particles 46 to the correct polarity. Thereafter the charged toner layer 47 is rotated past a toner layer pattern-forming gravure roll 50, whereby a peak and valley pattern is formed in the toner layer 47, and then the toner layer 47 is presented to the latent image to develop the same.

Following development, the donor roll is prepared for toner reloading by exposing the residual toner thereon to a neutralizing corona charge means 52 to make easier the removal of the residual toner by way of a cleaning brush 54 equipped with a vacuum means 56.

Figure 3:
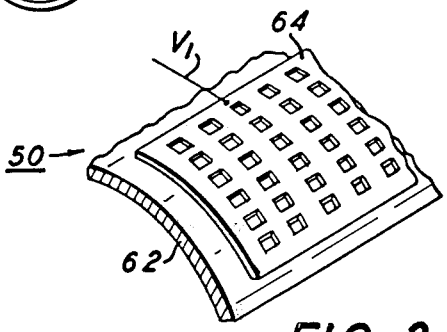
FIG. 3 is a view of a toner layer pattern forming roll.
Figure 4:
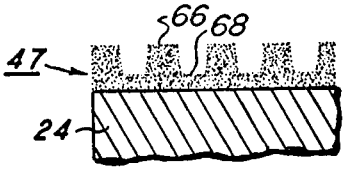
FIG. 4 is a view of the donor roll with a toner layer thereon shown in section after a pattern has been formed therein.

Referring to FIG. 3, the gravure roll 50 comprises a support drum 62 on which a copper film electrode 64 in the form of a grid pattern is fixed. The support may be either a conductive or a dielectric material. The roll 50 is so positioned that outer surface of the grid pattern 54 is spaced 2 to 10 microns from the outer surface of the toner layer on the donor roll 24. A voltage potential $V_1$ is applied to the grid 64. That portion of the donor opposite the gravure roll 50 is programmed to be at ground potential. The attractive field set up by the potential between the donor roll 24 and the grid 54 is predetermined so that a substantial amount of toner is removed from the toner layer and attracted to the grid 54 thereby leaving a predetermined pattern of individual peaks 66 surrounded by a continuous valley 68 in the toner particle layer as shown in FIG. 4. The valleys 68 correspond to the toner removed by the grid electrode 64.

When the donor 24 presents the patterned toner layer 47 to the electrostatic latent image, the weakest charged portion of the image will attract only the toner from the portion of the layer which is closest thereto, i.e., the peaks 66 thereby presenting a dot pattern development thereon. The strongest charged portion of the electrostatic latent image will attract toner not only from the closest portion or peaks 66 but will also attract toner from the valleys 68 which will fully develop the image where the charge is strongest. The charged pattern of the latent image which is between the weakest and strongest charge will attract a broadening pattern of toner from the peaks 66 as well as from the valleys 68 as the charge gets stronger. Thus, one can see that there will be many distinctive steps in grey scale rendition.

The developed image characteristics can be varied in accordance with the attractive field set up by the potential between the donor 24 and the gravure grid 64 which can be in a range between the electrostatic latent image background potential and the full potential on the photoreceptor. Thus, assuming a positive charge on the photoreceptor and negatively charged toner, the potential on the grid 64 can be in a range between +100 volts to +800 volts while the potential of the donor can be ground potential. As the lower potential range on the grid 64 is approached, less toner will be removed from the toner layer resulting in shallow and narrow valleys, while as the upper potential range on the grid 64 is approached, more toner will be removed from the toner layer resulting in deeper and wider valleys. For all practical purposes, when the potential of the gravure grid 64 is at background potential, the toner layer on the donor roll 24 is such that normal development takes place rather than half-tone development and therefore this potential on the gravure roll could be utilized when half-tone development is not desired. At this background potential, the gravure roll will act as a roll means for removing a substantial amount of toner from the layer 47 which would otherwise be attracted to the background. When the gravure grid 64 is at a potential which is the full potential on the photoreceptor, only half-tone development will occur on the highest charged portions of the image. Thus, if only half-tone development without much distinction in grey scale rendition is desired, the gravure grid 64 would be set at full photoreceptor potential.

From the above, it can be seen that when a given electrode pattern is utilized for the gravure roll, the distinctive steps in grey scale rendition obtained by the method of this invention can be changed by varying the potential on the gravure roll. Also, by changing the electrode pattern on the gravure roll, the distinctive steps of grey scale rendition may also be varied. The electrode may be any type of pattern desired as long as it will form a pattern of peaks and valleys in the toner layer 47 on the donor roll 24.

While the donor roll 24 is described as a microfield donor roll, any type donor roll may be utilized. The key factor is that the donor roll must have a layer of toner thereof and that a field be set up between the donor roll and the gravure roll which will attract the particles to the gravure roll in such a manner that peaks and valleys are formed in the toner layer.

While the photoreceptor 10, the donor roll 24, and the pattern-forming member 50 have each been described as rolls, any one of them or all of them may be in the form of a belt.

What is claimed is:

1. Copying apparatus for effecting distinctive steps in grey scale rendition, said apparatus comprising: a photoreceptive surface bearing an electrostatic latent image thereon; a donor member having a layer of toner particles thereon charged to the opposite polarity of said latent image; a pattern forming member; said pattern-forming member having electrode means thereon: said electrode means being arranged in such a manner on said pattern forming member to create a predetermined pattern of peaks and valleys in said toner layer when a predetermined field is established between said electrode means and said donor member; means for causing relative movement between said photoreceptor, said donor member and said pattern-forming member; said photoreceptor, said donor member, and said pattern-forming member being so located relative to each other than said donor member will transport a layer of toner particles to said pattern-forming member and then adjacent to said photoreceptor to present the layer of toner particles to said latent image for development thereof; means for establishing said predetermined field between said donor member and said electrode means on said pattern-forming member for attracting toner particles fron said toner layer to said electrode mans to create said predetermined pattern of peaks and valleys in said toner layer.

2. The apparatus as recited in claim 1 wherein said electrode means is in the form of a grid pattern.

3. Apparatus for developing latent electrostatic images carried by a substrate comprising a donor member, means for loading said donor member with a layer of toner, charging means for imparting a uniform electrical charge of predetermined polarity to said donor layer, means for subjecting said charged toner layer to an electrostatic field having an intensity varying in accordance with a grid-like pattern to create a corresponding pattern of hills and valleys in said toner layer, and means for presenting said patterned toner layer to said substrate for developing said images, whereby the grey scale content of said images tend to be preserved.

4. A development system for developing latent electrostatic images carried by a substrate, said system comprising the combination of a reservoir for storing a supply of toner, a donor member for transporting toner from said reservoir to said substrate via a predetermined path, means for loading said donor member with a layer of toner having an electrical charge of a predetermined polarity selected to enable said images to electrostatically attract toner from said donor member, a grid-like electrode positioned adjacent said path, and means coupled to said donor member and to said electrode for creating an electrical field therebetween, said field being selectively remove toner from discrete areas of said donor member, whereby the toner layer presented to said substrate has a predetermined pattern of hills and valleys, thereby tending to preserve any gray scale content of said image.

5. The development system of claim 4 wherein said donor member is a roll which is partially submerged in said reservoir and spaced a predetermined distance from said substrate, said roll being rotated in a predetermined direction to transport toner along a path running from said reservoir, past said electrode, and then to said substrate.

6. The development system of claim 5 wherein said means for loading said donor member includes a corona generator for imparting said charge to said toner layer, said corona generator being positioned adjacent said roll at a point in said path between said reservoir and said electrode.

7. The development system of claim 5 wherein said electrode has a roll-like configuration and is rotatably driven, and said development system further includes means adjacent said electrode for removing toner therefrom.

8. The development system of claim 4 wherein said doner member is a roll which is rotated in a predetermined direction to transport toner along a path running from said reservoir, past said electrode, then past said substrate, and finally back toward said reservoir.

9. The development system of claim 8 further including cleaning means adjacent said roll at a point between said substrate and said reservoir for removing toner from said roll after the toner has been transported past said substrate.

10. The development system of claim 9 wherein said roll is partially submerged in said reservoir and spaced a predetermined distance from said substrate.

11. The development system of claim 10 wherein said electrode has a roll-like configuration and is rotatably driven, and said development system further includes means adjacent said electrode for removing toner therefrom.

12. The development system of claim 11 wherein said means for loading said donor member includes a corona generator for imparting said charge to said toner layer, said corona generator being positioned adjacent said roll at a point in said path between said reservoir and said electrode.

* * * * *